US005477056A

United States Patent [19]

Hirota et al.

[11] Patent Number: 5,477,056

[45] Date of Patent: Dec. 19, 1995

[54] CIRCULAR ACCELERATOR, OPERATION METHOD THEREOF, AND SEMICONDUCTOR IRRADIATION SYSTEM

[75] Inventors: Junichi Hirota, Hitachi; Kazuo Hiramoto, Hitachiota; Masatsugu Nishi, Katsuta, all of Japan

[73] Assignee: Hitachi, Ltd., Tokyo, Japan

[21] Appl. No.: 102,737

[22] Filed: Aug. 6, 1993

[30] Foreign Application Priority Data

Aug. 7, 1992 [JP] Japan ..... 4-211240

[51] Int. Cl.[6] ..... H05H 7/10

[52] U.S. Cl. ..... 250/492.2; 372/2; 315/503

[58] Field of Search ..... 328/233, 235, 328/237; 250/492.2, 492.1, 493.1, 494.1; 372/2

[56] References Cited

U.S. PATENT DOCUMENTS

| | | | |
|---|---|---|---|
| 4,442,522 | 4/1984 | Brau et al. | 372/2 |
| 4,491,948 | 1/1985 | Deacon et al. | 372/2 |
| 4,623,847 | 11/1986 | Anderberg et al. | 328/235 |
| 4,631,743 | 12/1986 | Tomimasu et al. | 378/138 |
| 4,856,037 | 8/1989 | Mueller et al. | 250/492.2 |
| 4,992,746 | 2/1991 | Martin | 378/34 |
| 5,001,734 | 3/1991 | Uda et al. | 250/492.2 |

FOREIGN PATENT DOCUMENTS

| | | | |
|---|---|---|---|
| 3280586 | 12/1991 | Japan | 372/2 |

OTHER PUBLICATIONS

Technical magazine "Monthly Physics" vol. 5, No. 11, 1984, (N42) pp. 711–721.

Technical magazine "Monthly Physics" vol. 4, No. 5, 1983, (N24), pp. 295–301.

JP–A–3–211817.

U.S. Appln. No. 07/733645, filed on Jul. 22, 1991.

U.S. Appln. No. 07/833660, filed on Feb. 11, 1992.

LEDA–F Storage Ring, IEEE Trans. on Nuclear Sci., vol. NS–26 No. 3 (Jun., 1979), 3836–38.

*Primary Examiner*—James Beyer

*Attorney, Agent, or Firm*—Antonelli, Terry, Stout & Kraus

[57] ABSTRACT

A small-sized circular accelerator capable of generating radiation of high brightness, an operation method of the circular accelerator, and a semiconductor irradiation system capable of using radiation of high brightness. An electron beam emitted from a pre-accelerator is injected to the inside of the storage ring by an injector, and accelerated and stored. Thereafter, each of insertion devices respectively disposed in linear orbit sections between main bending magnets and auxiliary bending magnets are excited to generate an alternating field therein. A meandering or spiral movement of the electron beam is caused by this alternating field. By superposing radiations emitted from vertexes of the meandering orbit or the spiral orbit, radiation having high brightness is generated.

13 Claims, 5 Drawing Sheets

CIRCULAR ACCELERATOR, OPERATION METHOD THEREOF, AND SEMICONDUCTOR IRRADIATION SYSTEM

BACKGROUND OF THE INVENTION

The present invention relates to a circular accelerator for electrons or positrons, and in particular to a small-sized circular accelerator suitable for generating synchrotron orbital radiation having high brightness and an operation method thereof.

As for conventional circular accelerators, there are synchrotron orbital radiation generators as described in technical journal, "Monthly Physics", Vol. 5, No. 11, 1984, pp. 711–721. The principle and experiment of free electron laser which converts energy of an electron beam to energy of coherent light are described in the Monthly Physics, Vol. 4, No. 5, 1983, (Whole Number 24). By using a schematic diagram of a synchrotron orbital radiation generator as shown in FIG. 2, an example of a conventional technique will now be described. An electron beam or positron beam (hereafter referred to as "electron beam or the like") emitted from a pre-accelerator 21 is injected into a storage ring by an injector system 22. The injected electron beam or the like is held on a closed orbit 28 by focusing or defocusing quadrupole magnets 26, orbit correcting steering magnets 27, and bending magnets 23. In case of a storage ring having an acceleration function, the electron beam or the like is thereafter accelerated up to desired energy in the storage ring by a high frequency accelerating cavity 25. In case the electron beam or the like is injected with desired energy, it is stored while being kept at that energy. When the electron beam or the like stored with desired energy circulates in the storage ring, the electron beam or the like emits a part of the energy as radiation 24 every time it is bent by the bending magnets 23. This radiation is used for semiconductor lithography, for example. (See JP-A-3-211817, for example.) By compensating the energy lost as a result of this emission of radiation by using the high frequency accelerating cavity 25 provided in the storage ring, the electron beam or the like having desired energy can be held on the closed orbit 28 in the storage ring. As a method for increasing the brightness of a long wavelength area of the radiation 24 emitted from the bending magnets 23 and insertion devices 18 are used. In the insertion device 18, radiations emitted from vertexes of a meandering orbit or a spiral orbit are overlapped with each other by applying an alternating field along the closed orbit 28 in the storage ring and causing a meandering or spiral movement of the electron beam or the like.

However, the insertion device must be disposed in a linear or straight orbit section where the electron beam or the like moves linearly or in a straight path. Therefore, there is a problem that a large number of insertion devices cannot be disposed in a storage ring for which a smaller size is required. That is to say, a small-sized storage ring has a small linear orbit section. In the linear orbit section, the quadrupole magnets, steering magnets, injector system, and high frequency accelerating cavity are disposed as described before. Therefore, it is impossible to raise the brightness by disposing a large number of insertion devices while maintaining the small size.

As to improvements on circular accelerators, U.S. patent application Ser. No. 07/733645 was filed on Jul. 22, 1991 (based on Japanese patent application No. 2-190543) and entitled "Circular accelerator, method of injection of charged particle thereof and apparatus for injection of charged particle thereof", and U.S. patent application Ser. No. 07/833660 was filed on Feb. 11, 1992 (based on Japanese patent application No. 3-54338) and entitled "Circular Accelerator and a Method of Injection Beams Therein". These U.S. applications are assigned to the present assignee.

SUMMARY OF THE INVENTION

An object of the present invention is to provide a small-sized circular accelerator capable of generating synchrotron orbital radiation having high brightness and an operation method thereof. Another object of the present invention is to provide a semiconductor irradiation system capable of using synchrotron orbital radiation having high brightness.

According to a first aspect of this invention, means for superposing radiations are provided in each bending section used for bending an electron beam or a positron beam.

According to a second aspect of this invention, a plurality of bending magnets are provided in each bending section for bending an electron beam or a positron beam, the bending magnets including sets of adjacent bending magnets having different strengths of magnetic field, and an insertion device is provided between the bending magnets.

According to a third aspect of this invention, a plurality of bending magnets are provided in each bending section for bending an electron beam or a positron beam, the bending magnets including sets of adjacent bending magnets having different bending radii, and an insertion device is provided between the bending magnets.

According to a fourth aspect of this invention, a plurality of bending magnets are provided in each bending section for bending an electron beam or a positron beam, the bending magnets including sets of adjacent bending magnets having different bending angles, and an insertion device is provided between the bending magnets.

According to a fifth aspect of this invention, a plurality of bending magnets are provided in each bending section for bending an electron beam or a positron beam, the bending magnets including sets of adjacent bending magnets having different strengths of magnetic field and sets of adjacent bending magnets having equal strengths of magnetic field, and an insertion device is provided between the bending magnets having equal strengths of magnetic field.

According to a sixth aspect of this invention, in radiation emitted from each bending section for bending an electron beam or a positron beam, radiation of an area of wavelength longer than the peak wavelength maximizing the brightness is used.

According to a seventh aspect of this invention, insertion devices are activated at the time of injection of an electron beam or a positron beam so as to shorten the radiation damping time of betatron oscillation of the beam.

According to an eighth aspect of this invention, a semiconductor irradiation system includes a circular accelerator having a plurality of bending magnets provided in each bending section for bending an electron beam or a positron beam, sets of adjacent bending magnets having different strengths of magnetic field being included in the bending magnets, and further having insertion devices provided between the bending magnets; means for reflecting or focusing radiation emitted from a bending section; and a pattern transfer unit for transferring a desired pattern onto a semiconductor substrate by using the radiation reflected or focused by the means.

According to the above first aspect, means for superposing radiations are provided in each bending section, and hence radiations emitted from an electron beam or the like can be superposed in the bending section. Therefore, radiation having high brightness can be generated.

According to the above second aspect and fifth aspect of this invention, a plurality of bending magnets including sets of adjacent bending magnets having different strengths of magnetic field are provided in each bending section. By suitably selecting strengths of magnetic fields of bending magnets, therefore, a linear orbit section can be provided between bending magnets with little change in orbit length of the bending section. By providing an insertion device in a linear orbit section between the bending magnets, it is possible to cause a meandering or spiral movement of the electron beam or the like in the insertion device and superpose radiations emitted from vertexes of the meandering orbit or the spiral movement. Therefore, it is possible to generate radiation having high brightness without changing the size of the small-sized storage ring.

According to the above third aspect of the present invention, a plurality of bending magnets including sets of adjacent bending magnets having different bending radii are provided in each bending section. By suitably selecting bending radii of bending magnets, therefore, a linear orbit section can be provided between bending magnets with little change in orbit length of the bending section. By providing an insertion device in a linear orbit section between the bending magnets, therefore, it is possible to generate radiation having high brightness without changing the size of the small-sized storage ring.

According to the above fourth aspect of the present invention, a plurality of bending magnets including sets of adjacent bending magnets having different bending angles are provided in each bending section. By suitably selecting bending angles of bending magnets, therefore, a linear orbit section can be provided between bending magnets with little change in orbit length of the bending section. By providing an insertion device in a linear orbit section between the bending magnets, therefore, it is possible to generate radiation having high brightness without changing the size of the small-sized storage ring.

According to the above sixth aspect of this invention, in radiation emitted from a bending section, radiation of a wavelength longer than the peak wavelength maximizing the brightness is used. By suitably selecting reflecting means such as a mirror, therefore, radiation can be reflected and focused over a wide range of reflection angle. As a result, radiation having high brightness can be obtained.

According to the above seventh aspect of this invention, the insertion devices are activated at the time of injection of an electron beam or a positron beam so as to shorten the radiation damping time of betatron oscillation of the beam. Therefore, an electron beam or the like having low energy can be injected to the storage ring a large number of times. As a result, it is possible to increase the storage current within the storage ring and generate radiation having high brightness.

According to the above eighth aspect of this invention, a plurality of bending magnets including sets of adjacent bending magnets having different strengths of magnetic field are provided in each bending section. By suitably selecting strengths of magnetic field of bending magnets, therefore, a linear orbit section can be provided between bending magnets with little change in orbit length of the bending section. By providing an insertion device in a linear orbit section between the bending magnets, therefore, it is possible to generate radiation having high brightness without changing the size of the small-sized storage ring. By using this radiation, semiconductor irradiation process with high brightness can be conducted.

DESCRIPTION OF THE PREFERRED EMBODIMENTS

Figure 1:
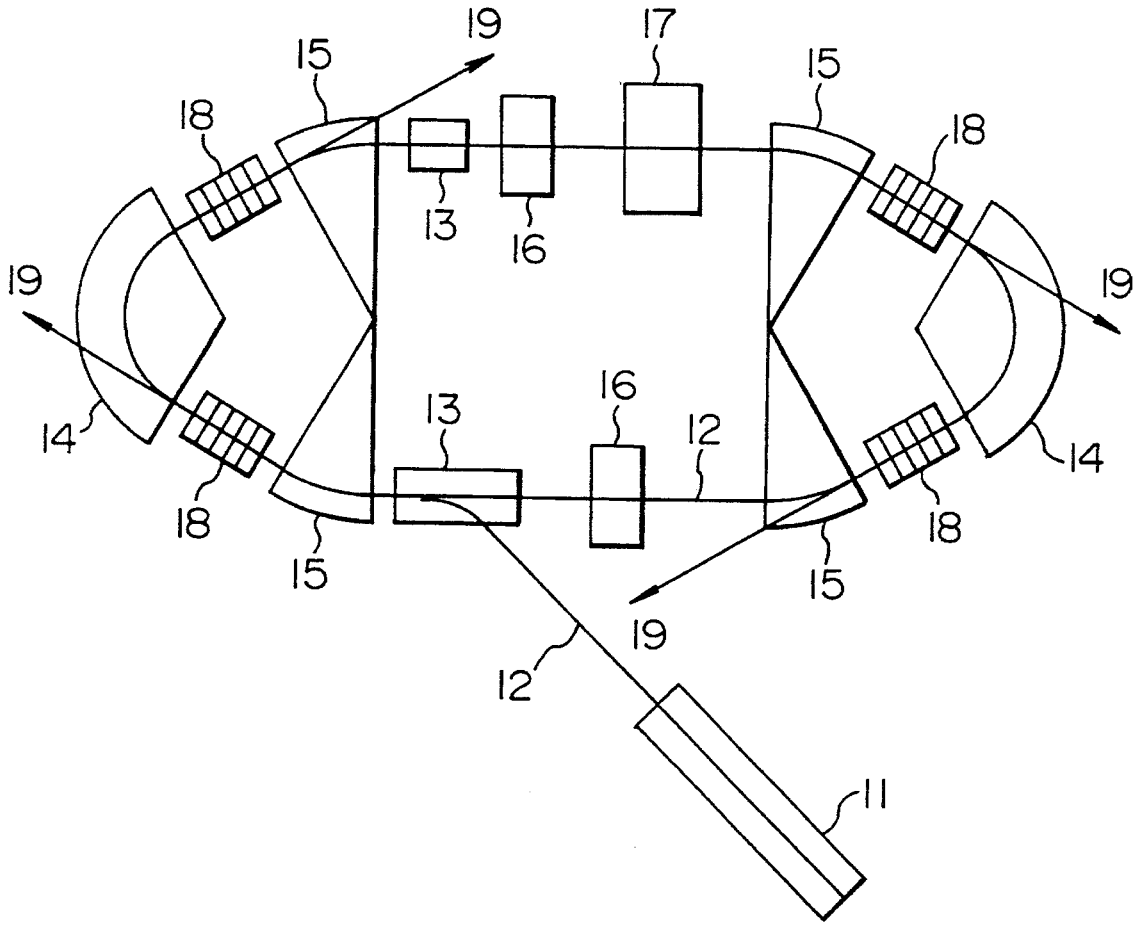
FIG. 1 is a schematic diagram showing a first embodiment of the present invention.

A first embodiment of the present invention will now be described by referring to FIG. 1. FIG. 1 is a schematic diagram of a synchrotron orbital radiation generator of race track type using an electron beam. The generator includes a storage ring for accelerating and storing an electron beam and a pre-accelerator 11 for injecting an electron beam 12 to the storage ring. The storage ring includes an injector 13 for the electron beam 12, focusing or defocusing quadrupole magnets 16, a high frequency accelerating cavity 17 for supplying energy, and bending sections for bending the beam. Each bending section has a main bending magnet 14 and auxiliary bending magnets 15. The strength of magnetic field of the main bending magnet 14 is made larger than that of the auxiliary bending magnet 15. In linear orbit sections formed between the main bending magnets 14 and the auxiliary bending magnets 15, four insertion devices 18 are disposed. The electron beam 12 emitted from the pre-accelerator 11 is injected to the inside of the storage ring by the injector 13. Thereafter, the main bending magnets 14, auxiliary bending magnets 15, quadrupole magnets 16, and high frequency accelerating cavity 17 are subjected to pattern running. Thereby the electron beam is subjected to synchrotron acceleration and stored in the storage ring. After the electron beam has been stored, the insertion devices 18 respectively disposed in the linear orbit sections between the main bending magnets 14 and the auxiliary bending magnets 15 are excited. Thereby, an alternating field is generated in each insertion device. A meandering or spiral movement of the electron beam or the like is caused by this alternating field. Radiations emitted from vertexes of the meandering orbit or the spiral orbit are thus superposed. Therefore, it becomes possible to generate radiation 19 having high brightness. The above described superposition of radiations can also be done by using a permanent magnet as the insertion device and narrowing its magnetic pole gap.

Increase of the brightness obtained when the configuration of FIG. 1 is used will now be described. It is now assumed that a race track microtron is used as the pre-accelerator 11 and electrons are accelerated to approximately 20 MeV and injected, and thereafter accelerated to 1 GeV and stored in the storage ring. At this time, the magnetic field B of a bending magnet becomes $$B=E/(0.3\rho) \quad (1)$$

where

B=bending field (T)

E=energy of electrons (GeV)

ρ=radius of curvature of bending magnet (m).

The peak wavelength λ of radiation emitted from an insertion device 18 can be represented as $$\lambda=\lambda_0(1+cK^2)/2\gamma^2 \quad (2)$$

where

λ=peak wavelength of radiation emitted from the insertion device (m)

$\lambda_0$=pitch of the insertion device (m)

c=constant depending upon type of the insertion device
c=½ for planar type
c=1 for helical type K=constant featuring the insertion device
K=93.4 $B\lambda_0$ γ=relativistic energy factor
(=beam energy of electrons/rest energy of electrons).

Figure 3:
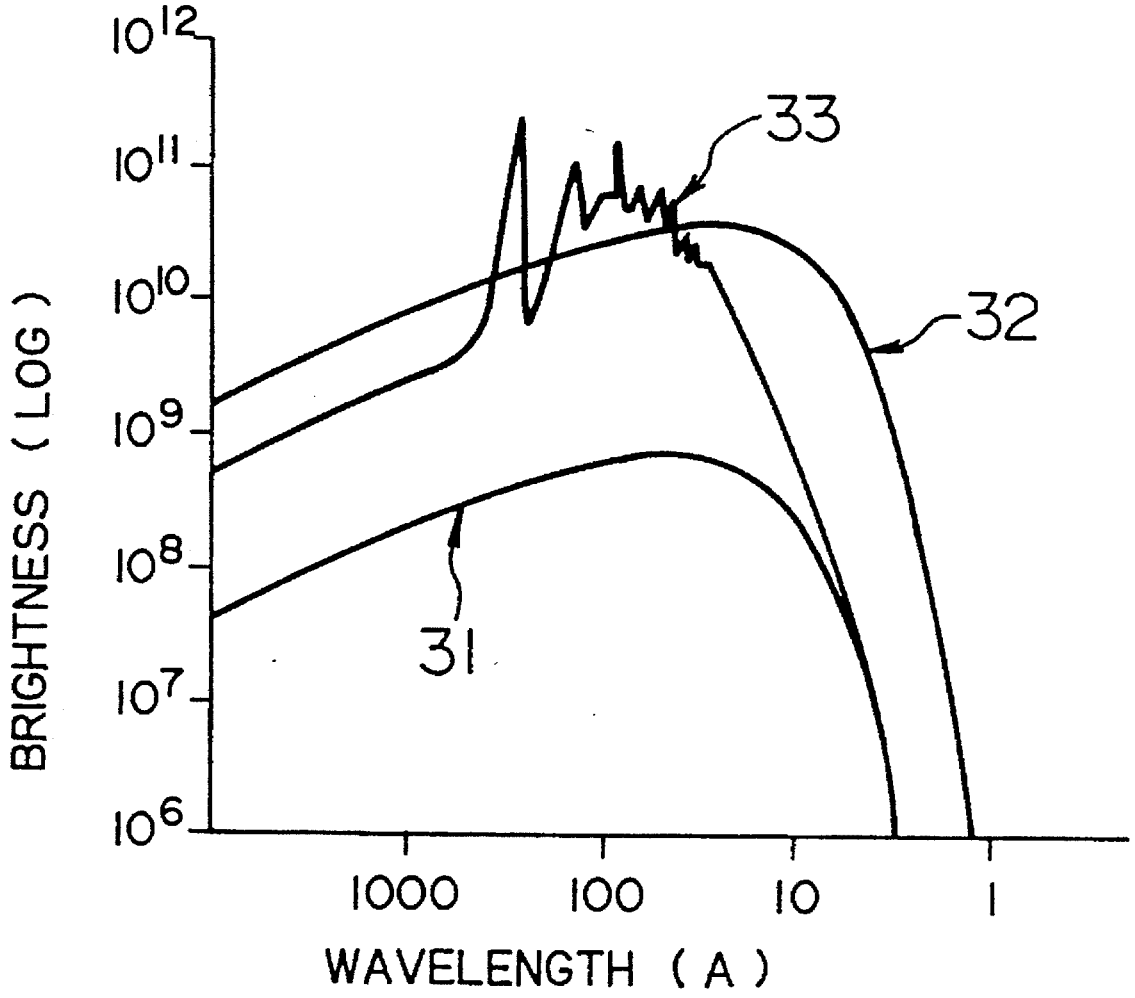
FIG. 3 is a diagram showing spectral characteristics of radiation emitted from a bending magnet and an insertion device.

As insertion devices, there are undulators and wigglers. Insertion devices in which the oscillation frequency of the electron beam is high are referred to as undulators. Insertion devices in which the oscillation frequency of the electron beam is low are referred to as wigglers. If the constant K expressed in equation (2) is used, insertion devices with K≦1 are undulators whereas insertion devices with 1<K are wigglers. Because of difference in frequency, undulators and wigglers have different brightness increasing effects. That is to say, in undulators, brightness of specific wavelength can be selectively increased as represented by curve 33 of FIG. 3 showing the radiation spectrum emitted from the undulator. The reason is that high frequency in undulators causes sufficient superposition of radiations and hence wavelengths are made uniform. On the other hand, wigglers have no wavelength selectivity unlike undulators and have high brightness over a wide wavelength area as indicated by curve 32 of FIG. 3 showing the radiation spectrum emitted from the wigglers. Especially, wigglers have a feature that brightness on the shorter wavelength side can be made higher as compared with a radiation spectrum emitted from bending magnets as indicated by curve 31 of FIG. 3. The reason is that the frequency in wigglers is low and hence superposition of radiations is not conducted sufficiently.

Description will hereafter be made by using helical undulators as an example of insertion devices. Brightness P of radiation when helical undulators are used can be represented as $$P=6.5\times10^{11}E^2N^2 \quad (3)$$

where

P=brightness when insertion devices are used

N=periodicity of the insertion devices.

Brightness P' of radiation obtained when insertion devices are not used is represented as $$P'=2\times10^{11}E^2 \quad (4)$$

In case insertion devices are used, the brightness can be increased as compared with the conventional technique in proportion to square of periodicity of insertion devices.

Miniaturization will now be described. It is now assumed as an example that the wavelength of radiation is approximately 150 ↑. Assuming that the energy of electrons is constant as represented by E=1 GeV so as to minimize a drop in radiation brightness, the conventional apparatus will now be compared with the present invention by referring to FIGS. 2 and 1.

First of all, the size of the conventional apparatus is estimated. In the conventional apparatus, peak wavelength λ' of radiation emitted from a bending magnet is given by $$\lambda'=18.6/(E^2B) \quad (5)$$

where λ' is peak wavelength of radiation emitted from a bending magnet (Å).

Figure 2:
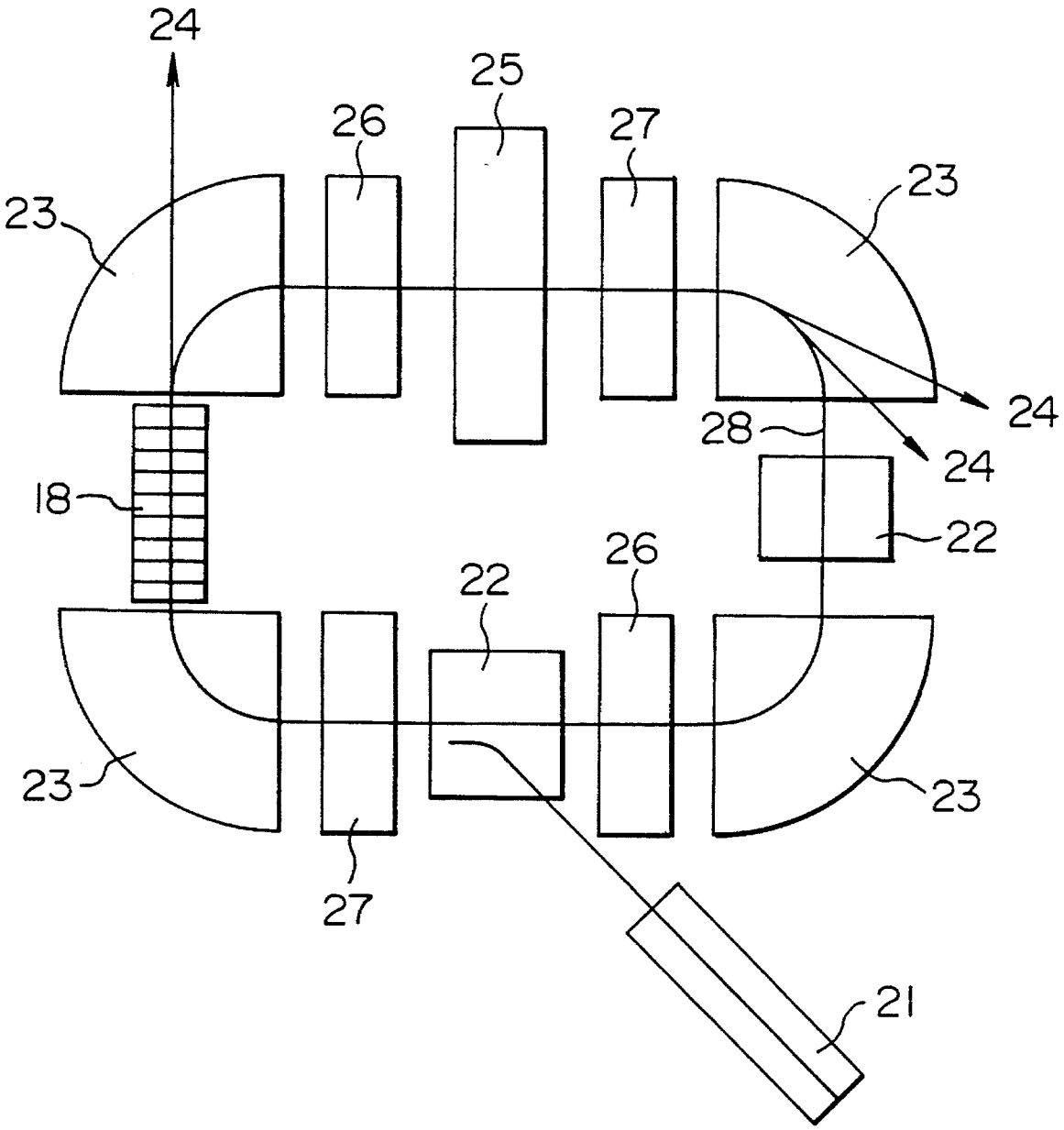
FIG. 2 PRIOR ART
FIG. 2 is a schematic diagram showing a conventional synchrotron orbital radiation generator.

From equation (5), the magnetic field of the bending magnet needed to obtain peak wavelength λ'=150 Å becomes B=0.12 T. From equation (1), the radius of curvature of the bending magnet corresponding to this is ρ=27.8 m. If the storage ring as shown in FIG. 2 is formed by using this bending magnet, the length of circumference of the storage ring becomes very long as long as approximately 170 m at least. Giving priority to miniaturization even if the brightness falls to some degree, therefore, using radiation belonging to an area of wavelength longer than the peak wavelength is thought of. For miniaturizing the storage ring, the radius ρ of curvature of bending magnets must be made small. In order to make the radius ρ of curvature smaller than equation (1), the bending magnetic field B must be made large. As a result, the peak wavelength λ' of radiation expressed by equation (5) becomes small. Assuming now that the peak wavelength λ'=10 Å, it is understood from the spectrum characteristics of radiation represented by curve 31 of FIG. 3 that the brightness at the wavelength of 150 Å falls down to approximately ⅓ to ½ of the brightness P' at the peak wavelength. If this brightness drop is admitted, the bending magnetic field becomes B=1.9 T from equation (5). From this and equation (1), the radius of curvature becomes ρ=1.8 m. As a result, the circumference length of the storage ring inclusive of the linear orbit sections can be made as small as approximately 17 m.

On the other hand, in case of the present invention shown in FIG. 1, the insertion device for realizing the peak wavelength of radiation λ=150 Å has a pitch of 5 cm, a periodicity of 10, K=1.14 (magnetic field of insertion device=0.2 T), and a total length of 0.8 m, for example. For comparison with the conventional apparatus, it is now assumed that the magnetic field of the auxiliary bending magnets 15 is B=1.9 T in the same way as the conventional apparatus. Assuming in this case that the magnetic field of the main bending magnets is 4 T, each linear orbit section for disposing an insertion device between the main bending magnet and auxiliary bending magnet can be formed over a length of approximately 1 m. The circumference length of this storage ring is approximately 17 m, which becomes nearly identical with that of the ring of the conventional type with the peak wavelength of 10 Å. By intensifying the magnetic field of the auxiliary bending magnets 15 and/or providing the magnetic field with a gradient (i.e., forming a weak focus field), a further smaller-sized system can be formed. From equations (3) and (4), the brightness of radiation emitted from insertion devices in this case becomes approximately 325 times as strong as that of the conventional type and becomes equivalent to storing a current which is approximately 325 times as large as that of the conventional type. As heretofore described, radiation with high brightness can be generated by a small-sized apparatus in the present embodiment.

In the above described embodiment, the strength of magnetic field of the main bending magnets 14 has been made larger than that of the auxiliary bending magnets 15. However, a similar effect can be obtained even if the radius of curvature or bending angle of the main bending magnets 14 is made larger than the radius of curvature or bending angle of the auxiliary bending magnets 15 and insertion devices 18 are disposed in linear orbit sections formed between the main bending magnets 14 and the auxiliary bending magnets 15. Furthermore, a storage ring of race track type has been used in the above described embodiment. However, a similar effect is obtained even in storage rings having structures other than this.

Figure 4:
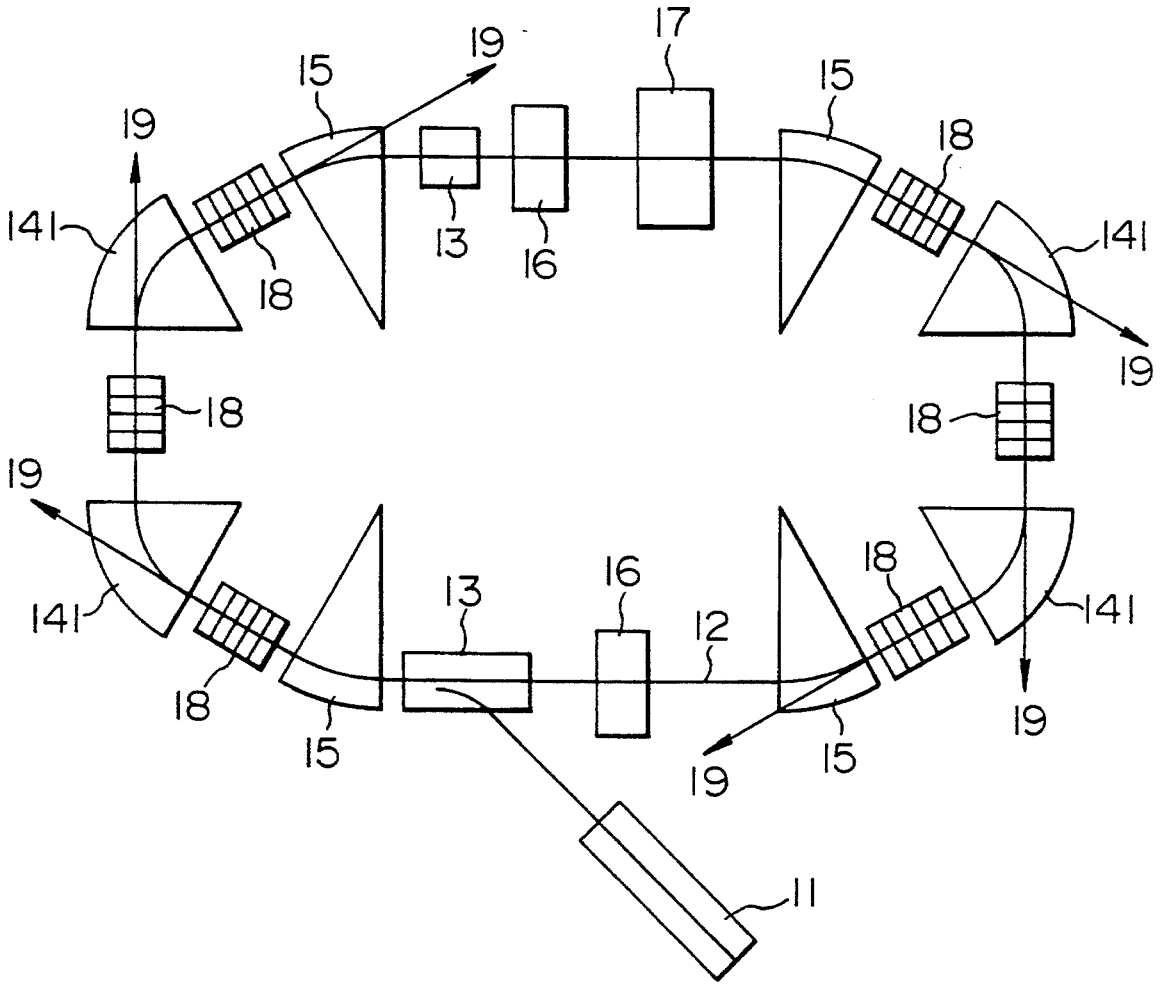
FIG. 4 is a schematic diagram showing a second embodiment of the present invention.

A second embodiment of the present invention will now be described by referring to FIG. 4. The basic configuration of the present embodiment is identical with that of FIG. 1. Each main bending magnet 14 of FIG. 1 is replaced by two main bending magnets 141 and an insertion device disposed between them. Configuration of other portions is identical with that of FIG. 1 and hence will not be described further. In the first embodiment shown in FIG. 1, the electron orbit of the bending section formed by the auxiliary bending magnets 15, the insertion devices 18, and the main bending magnet 14 is symmetrical with respect to the center line of the main bending magnet 14. Even if the main bending magnet 14 is divided along its center line, therefore, the electron orbit in other portions is subject to little influence. By dividing each main bending magnet along the center line, the second embodiment shown in FIG. 4 is obtained. Since a linear orbit section is formed between the main bending magnets 141 resulting from the bisection, an insertion device 18 can be disposed here as well. By making each of two bending sections have such a configuration as that of the present embodiment, therefore, six insertion devices can be disposed in the storage ring without significantly changing the circumference length of the storage ring. Therefore, radiation having high brightness can be generated in a small-sized storage ring. In addition, the area for taking out radiation can be expanded. As a result, the generated radiation can be used in a plurality of applications at the same time.

Figure 5:
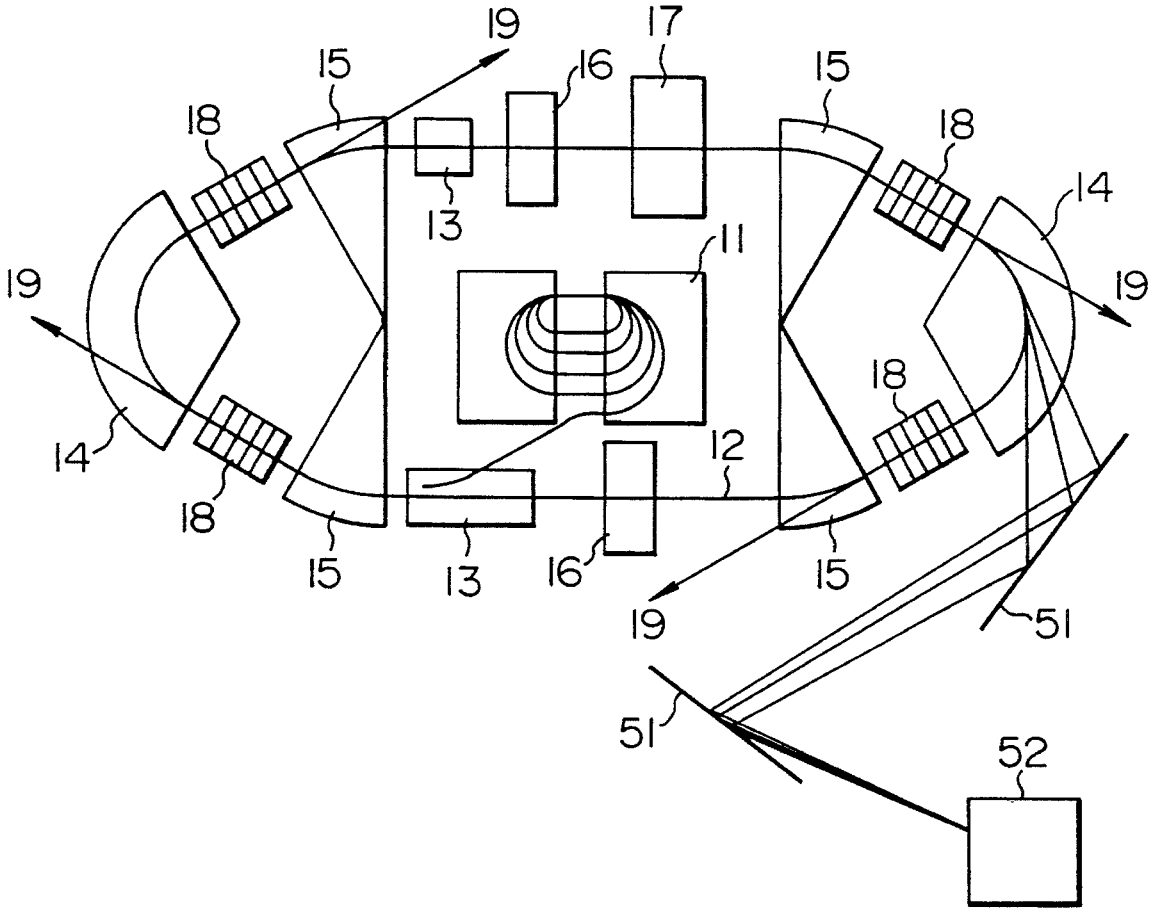
FIG. 5 is a schematic diagram showing a third embodiment.

A third embodiment of the present invention will now be described by referring to FIG. 5. In the present embodiment, a mirror 51 for focusing the radiation emitted from a bending magnet and a pattern transfer unit 52 for transferring a desired pattern onto a semiconductor substrate by using the radiation focused by the mirror 51 are disposed outside of the storage ring. Furthermore, the pre-accelerator 11 disposed outside of the storage ring in FIG. 1 is disposed inside of the storage ring. The basic configuration of the storage ring of the present embodiment is identical with that of FIG. 1, and hence its description will be omitted. The brightness of radiation other than the peak wavelength falls down as indicated by 31 of FIG. 3. However, this drop in brightness can be improved by focusing the radiation belonging to an area of wavelength longer than the peak wavelength included in radiation emitted from the main bending magnet 14 or auxiliary bending magnet 15. That is to say, use of radiation of the long wavelength area makes it possible to reflect or focus radiation with a mirror over a wide range of reflection angle. Therefore, the brightness of radiation can be raised. By leading the radiation of the long wavelength area raised in brightness to the pattern transfer unit 52, it can be used for reduction irradiation process or the like. In the present embodiment, radiation emitted from bending magnets is focused. By focusing radiation emitted from each insertion device, however, radiations from a plurality of insertion devices may be superposed to obtain radiation of higher brightness. Furthermore, in the present embodiment, disposition of the pre-accelerator 11 inside of the storage ring reduces the size of the whole apparatus and allows expanding the radiation takeout area to a wide range. Therefore, generated radiation can be used in a plurality of applications at the same time.

The operation method at the time of injection of an electron beam of low energy will now be described. In industry-oriented radiation generators, the first requisite is to be small in installation area. For that purpose, it is indispensable to have a function of accelerating electrons up to desired energy in the storage ring. According thereto, the injection energy can be lowered. Immediately after injection, the electron beam has large betatron oscillation. This amplitude is gradually damped because radiation is emitted when the electron beam passes through a bending magnet. When the energy of the electron beam is low, however, emitted radiation is long in wavelength and radiation power is also small, and hence this damping time is very long (several minutes to several tens minutes). Therefore, injection cannot be repeated a large number of times. As understood from equations (1) and (5), the peak wavelength of radiation is in inverse proportion to the cube of electron energy and in proportion to the radius of curvature of the bending magnets. Therefore, the radiation damping time can be shortened by exciting insertion devices disposed between main bending magnets and auxiliary bending magnets when an electron beam is injected to the storage ring having the configuration shown in FIG. 1 and thereby causing a meandering or spiral movement of the injected electrons to promote emission of radiation. If the radiation damping time is shortened, the spatial extent (emittance) of the injected electron beam can be made small and the loss of the injected electron beam can be suppressed. Furthermore, even in the low energy state, the electron beam can be injected a large number of times and the storage current can be made large. Therefore, radiation of high brightness can be generated.

In the embodiments heretofore described, electron beams are used. However, similar effects can be obtained even when a positron beam is used.

According to one of typical advantages of this invention, it becomes possible to provide a small-sized circular accelerator capable of generating radiation of high brightness, an operation method of the circular accelerator, and a semiconductor irradiation system capable of using radiation of high brightness. Furthermore, since radiation takeout area can be expanded, the generated radiation can be used in a plurality of applications at the same time.

We claim:

1. A circular accelerator including straight sections and bending sections for accelerating and storing therein an electron beam or a positron beam, the bending sections including:

sets of bending means for bending an orbital path of the beam, the bending means of each set being disposed adjacent one another and generating respective bending strengths different from one another for respective beam bending operations; and means disposed between the adjacent bending means of at least one of said sets for superposing and for extracting synchrotron orbital radiations of the beam.

2. An accelerator according to claim 1, wherein the accelerator enables a ring-like orbit of the beam by the straight sections and the bending sections, the sets of bending means of the bending sections comprising at least one first bending means for generating a first bending strength to cause a curved orbit section of the beam and at least two second bending means each for generating a second bending strength different from the first bending strength in order to cause different curved orbit sections of the beam, a first one of the sets including the first bending means and one of the at least two second bending means disposed adjacent to each other to cause therebetween an additional straight orbit section of the beam, and a second one of the sets including the first bending means and another of the at least two second bending means disposed adjacent to each other to cause therebetween another additional straight orbit section of the beam; the synchrotron orbital radiations superposing and extracting means each being disposed in the respective additional and another additional straight orbit sections between the first bending means and the respective one of the at least two second bending means.

3. An accelerator according to claim 1, wherein the accelerator is shaped as a storage ring delimiting an inside space defined by the straight sections and the bending sections, and further including a pre-accelerator positioned in the inside space of the storage ring.

4. An accelerator according to claim 2, wherein the accelerator is shaped as a storage ring delimiting an inside space defined by the straight sections and the bending sections, and further including pre-accelerator positioned in the inside space of the storage ring.

5. A semiconductor irradiation system for irradiating a semiconductor by radiation, the system comprising:

a circular accelerator according to claim 1;

means for reflecting or focusing the extracted synchrotron orbital radiations from the beam; and a pattern transfer unit for transferring a desired pattern onto a semiconductor substrate by using the reflected or focused extracted radiations.

6. A circular accelerator including straight sections and bending sections for accelerating and storing therein an electron beam or a positron beam, wherein the bending sections include:

a plurality of bending magnets for bending an orbit of the beam, the bending magnets including sets of bending magnets in which the bending magnets of each set are disposed adjacent to one another and generate respective strengths of magnetic field different from one another; and insertion devices each disposed between the adjacent bending magnets of a respective set.

7. An accelerator according to claim 6, wherein the bending magnets of each set have respectively different bending radii.

8. An accelerator according to claim 6, wherein the bending magnets of each set have respectively different bending angles.

9. An accelerator according to claim 6, wherein the insertion devices includes undulators.

10. An accelerator according to claim 6, wherein the insertion devices includes wigglers.

11. A circular accelerator including straight sections and bending sections for accelerating and storing an electron beam or a positron beam, wherein the bending sections include:

a plurality of bending magnets for bending an orbit of the beam and including at least one first set of bending magnets disposed adjacent to one another and generating respective strengths of magnetic field different from one another, and at least one second set of bending magnets disposed adjacent to one another and generating respective strengths of magnetic field equal to one another; and insertion devices each disposed between the adjacent bending magnets of a respective second set.

12. An accelerator according to claim 11, wherein the bending sections include additional insertion devices each disposed between the adjacent bending magnets of a respective first set.

13. A circular accelerator shaped as a storage ring for accelerating and circulating an electron beam or a positron beam in a ring-like closed orbit; the accelerator including straight sections each defining a straight orbit section of the closed orbit and including at least one injector, beam-focus control means, and high-frequency acceleration means; the accelerator further including:

bending sections including at least two bending means for bending the closed orbit of the beam and disposed adjacent to one another for generating respective bending strengths different from one another in order to define curved orbit sections of the closed orbit and to define an additional straight orbit section between the curved orbit sections; and means disposed in the additional straight orbit section for superposing and extracting synchrotron orbital radiations from the beam circulated therethrough.

* * * * *